US010584435B2

(12) United States Patent
King et al.

(10) Patent No.: US 10,584,435 B2
(45) Date of Patent: Mar. 10, 2020

(54) CLEANING APPARATUS

(71) Applicant: Delking (Pty) Ltd., Pretoria (ZA)

(72) Inventors: Denis John King, Johannesburg (ZA); Mathys Johannes Rossouw, Johannesburg (ZA)

(73) Assignee: Delking (Pty) Ltd., Pretoria (ZA)

( * ) Notice: Subject to any disclaimer, the term of this patent is extended or adjusted under 35 U.S.C. 154(b) by 1 day.

(21) Appl. No.: 15/517,237

(22) PCT Filed: Sep. 10, 2014

(86) PCT No.: PCT/ZA2014/000049
§ 371 (c)(1),
(2) Date: Apr. 6, 2017

(87) PCT Pub. No.: WO2016/040966
PCT Pub. Date: Mar. 17, 2016

(65) Prior Publication Data
US 2017/0306545 A1 Oct. 26, 2017

(51) Int. Cl.
*D06F 35/00* (2006.01)
*D06F 25/00* (2006.01)
(Continued)

(52) U.S. Cl.
CPC ..... *D06F 35/00* (2013.01); *D06F 23/00* (2013.01); *D06F 25/00* (2013.01); *D06F 33/02* (2013.01);
(Continued)

(58) Field of Classification Search
CPC ..... D06F 35/00; D06F 23/00; D06F 25/00; D06F 39/045; D06F 39/087; D06F 39/14;
(Continued)

(56) References Cited

U.S. PATENT DOCUMENTS 3,410,116 A * 11/1968 Levinson ..... A47L 15/0097 134/115 R
7,942,025 B1 * 5/2011 Musone ..... D06F 25/00 34/603

(Continued)

FOREIGN PATENT DOCUMENTS

EP 0281041 B1 * 9/1992 ..... D06F 35/006

OTHER PUBLICATIONS

Machine translation of EP-0281041-B1 . (Year: 1992).*

*Primary Examiner* — Joseph L. Perrin
(74) *Attorney, Agent, or Firm* — Wenderoth, Lind & Ponack, L.L.P.

(57) ABSTRACT

An apparatus for cleaning cloth which includes a body with an aperture, a closure, which is engageable with the aperture, a tub with an outer shell and a cylindrical inner cavity which corresponds with the aperture, a drum, which is positioned inside the cylindrical inner cavity and which includes a wall, with an inner surface, an outer surface and a plurality of perforations in the wait, a base and an opposing mouth which registers with the aperture, a driver which is connected to or engaged with the drum and which allows rotational movement of the drum about an axis, a generator and an electrical power supply, inside the body, wherein the power supply is adapted to provide pulsating electrical power to the generator and wherein the generator is actuable to produce pulses of microwave energy at least into part of the drum.

8 Claims, 12 Drawing Sheets

(51) Int. Cl.

| | |
|---|---|
| ***D06F 23/00*** | (2006.01) |
| ***D06F 39/14*** | (2006.01) |
| ***D06F 58/26*** | (2006.01) |
| ***D06F 33/02*** | (2006.01) |
| ***D06F 39/00*** | (2006.01) |
| ***D06F 39/04*** | (2006.01) |
| ***D06F 39/08*** | (2006.01) |
| ***H05B 6/80*** | (2006.01) |

(52) U.S. Cl.
CPC ..... *D06F 39/005* (2013.01); *D06F 39/045* (2013.01); *D06F 39/087* (2013.01); *D06F 39/14* (2013.01); *D06F 58/266* (2013.01); *H05B 6/80* (2013.01); *D06F 2202/02* (2013.01); *D06F 2202/04* (2013.01); *D06F 2202/085* (2013.01); *D06F 2202/12* (2013.01); *D06F 2204/02* (2013.01); *D06F 2204/04* (2013.01); *D06F 2204/06* (2013.01); *D06F 2204/08* (2013.01); *D06F 2204/10* (2013.01); *H05B 2206/046* (2013.01)

(58) Field of Classification Search
CPC ..... D06F 58/266; D06F 2202/02; D06F 2202/04; D06F 2202/085; D06F 2202/12; D06F 2204/02; D06F 2204/04; D06F 2204/06; D06F 2204/08; D06F 2204/10
See application file for complete search history.

(56) References Cited

U.S. PATENT DOCUMENTS

2002/0062667 A1* 5/2002 Ahmad ..... D06F 35/00 68/12.12
2016/0333514 A1* 11/2016 Zattin ..... D06F 39/007

* cited by examiner

CLEANING APPARATUS

BACKGROUND OF THE INVENTION

This invention relates to a method of cleaning cloth using pulsed microwave energy.

Machines which make use of microwave energy to clean and/or dry cloth are known in the art. Most of these machines focus on using microwaves to heat the water used during the cleaning process, thereby using less energy than machines that make use of, for example, heating elements. Machines which have a drying function focus on heating the water within the wet or damp cloth, speeding up the drying process.

Developments in this field of application, have been to positioning a microwave-generating device (the magnetron) within washing machines, as well as methods of directing microwaves to the desired objects, i.e., the water to be heated or the fabric to be dried. U.S. Pat. Nos. 4,356,640, 5,463,821 and 4,334,136 are examples in this regard.

An important piece of prior art in relation to the present invention is US Patent Application US2002/0062667, entitled "Method and apparatus for washing items having cloth with microwaves". The specification teaches an apparatus that relies on continuous microwave irradiation onto wet cloth in order to agitate water and soap/detergent molecules within the cloth. The agitation comes about as a result of rotational motion of the molecules due to said microwave irradiation, the primary effect of which is the enhanced cleaning effect of water and detergent. A secondary effect of such irradiation is an increase in temperature of the water itself.

A drawback of the apparatus is discovered upon practical use thereof. The microwave energy that can be used without adversely affecting the cloth was experimentally found to be relatively low. Consequently, the microwave irradiation would have to be applied for relatively long periods of time in order to achieve enhanced cleaning results. Even then, the degree of cleaning, whilst being better than that achieved through ordinary cleaning means, may not be much greater. The use of detergent would then be additionally needed in order to achieve the enhanced clean. The prior art therefore prescribes the use of detergent to achieve this.

The invention at least partially addresses the aforementioned limitations of the prior art.

SUMMARY OF INVENTION

The present invention provides an improved method of cleaning cloth utilizing microwave radiation and the pulsing thereof.

The invention provides an apparatus for cleaning cloth which includes a body with an aperture, a closure, which is engageable with the aperture, a tub with an outer shell and a cylindrical inner cavity which corresponds with the aperture, a drum, which is positioned inside the cylindrical inner cavity and which includes a wall, with an inner surface, an outer surface and a plurality of perforations in the wall, a base and an opposing mouth which registers with the aperture, a drive means which is connected to or engaged with the drum and which allows rotational movement of the drum about an axis, a generator and an electrical power supply, inside the body, wherein the power supply is adapted to provide pulsating electrical power to the generator and wherein the generator is actuable to produce pulses of microwave energy at least into part of the drum.

The closure may be a door which is fixed to, or removably engaged with, the body.

The body may include a plurality of vents which provide a passage for air into and out of the body.

The body may include an inlet and an outlet which allow water to enter and leave the body.

The drive means may include at least one pulley, which is engaged with the base of the drum, which is connected to an electric motor by means of a belt. Alternatively, the motor may drive the drum directly.

The drum may have a volume in the range of 10 to 100 litres.

The generator may be a magnetron.

The power supply of the magnetron may be a switched mode power supply.

The apparatus may include at least one of the following control elements located in or on the body; an air heating element, an air bypass flap, an air blower, a microwave choke, a microwave inlet, a water heater, and an exhaust air vent.

The apparatus may include a sensor to detect at least one of the following: microwave field strength, temperature within the drum, sump water level, water conductivity, drain water level, rinsing water temperature, exhaust gas quality, exhaust gas humidity, exhaust air temperature and inlet air temperature.

The apparatus may include a programmable microcontroller or microprocessor circuit, electronically interposed between the sensor and the at least one control element, to receive input from the sensor and, in response to control the operation of the control element.

By controlling the operation of the at least one control element, in response to input from the at least one sensor, the programmable microcontroller or microprocessor may be capable of controlling any one or more of the following: water flow, water quality, water level, microwave power, duty cycle, air velocity, air temperature and drum rotation (hereinafter collectively referred to as "washing parameters").

The apparatus may include a user interface which is capable of communicating the washing parameters listed above, to a user.

The user interface may allow a washing load setting to be input by the user. The washing load setting may relate to one of the following: mass of load of cloth to be cleaned, type of the cloth to be cleaned, and scheduling of cleaning.

The user interface may be capable of communicating the washing load settings to the programmable microcontroller or microprocessor circuit.

The invention also provides a method of cleaning cloth with the apparatus described in any one of the preceding claims, the method including the steps of:

a) placing the cloth into a drum;
b) moistening the cloth in the drum with a liquid; and
c) irradiating the cloth in the drum with the pulses of microwave energy generated by the generator.

The generator may generate pulses of microwave energy at a power density in the range 5 kW and 5000 kW per cubic meter of the volume of the drum. Preferably, the generator generates pulses of microwave energy at a power density of 100 kW per cubic meter of the volume of the drum.

The power of each pulse of microwave energy may be regulated using the power supply to be in a range of 1 kW to 30 kW. Preferably, the power of each pulse of microwave energy is regulated using the power supply to be in a range of 3 kW to 5 kW.

The pulses may be regulated using the power supply to be at duty cycles ranging between 5% and 33%.

The cloth may be moistened by spraying a stream of liquid into the drum.

The method may include an additional step of frequently or continuously draining the liquid out of the drum such that at least part of the cloth is not submerged during irradiation.

The method may include the additional step of introducing a hot air stream into the drum to dry the cloth.

BRIEF DESCRIPTION OF THE DRAWINGS

The invention is further described by way of example with reference to the accompanying drawings in which.

DESCRIPTION OF PREFERRED EMBODIMENT

Figure 1:
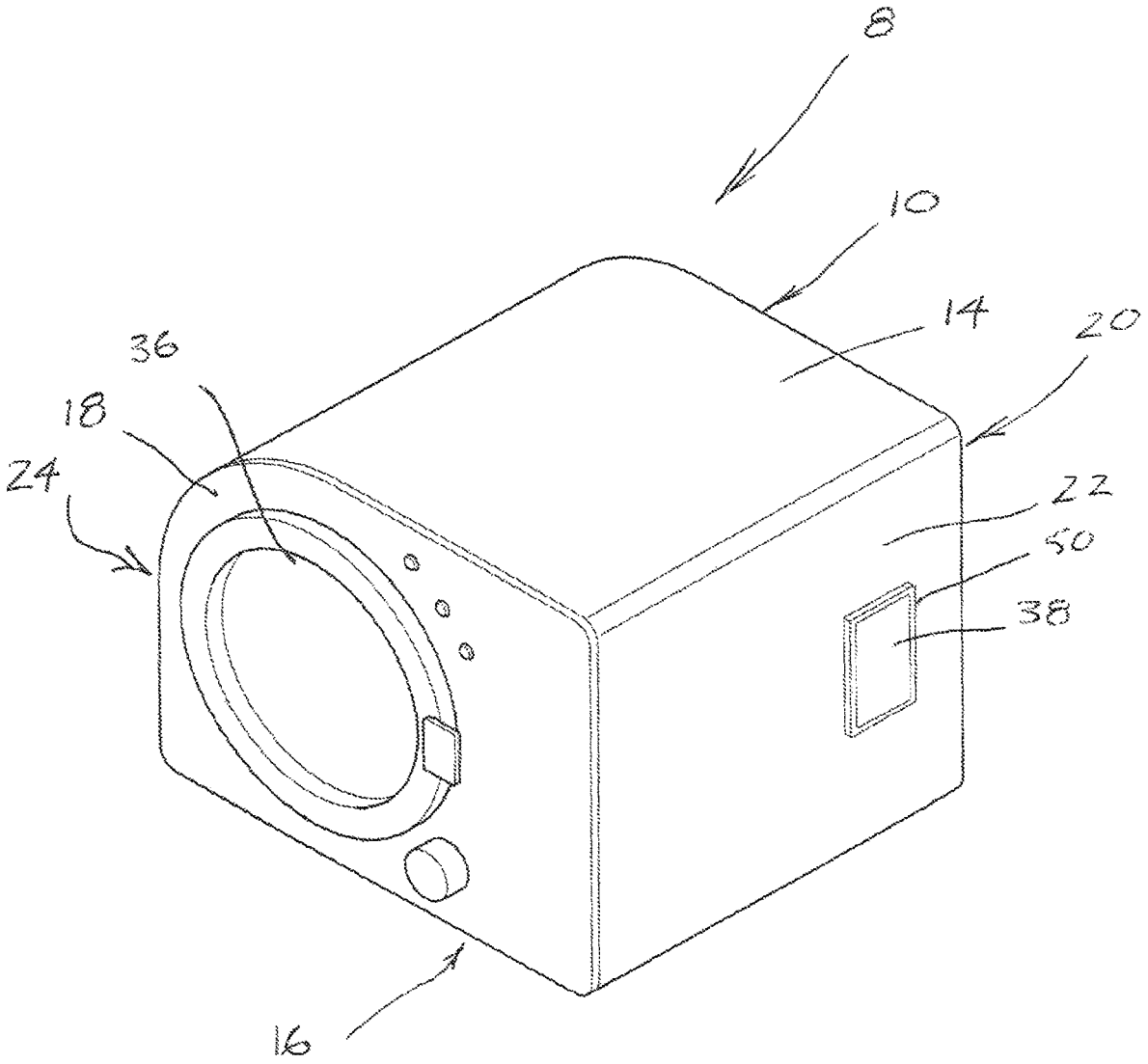
FIG. 1 is a perspective view of a cleaning apparatus according to the invention.
Figure 2:
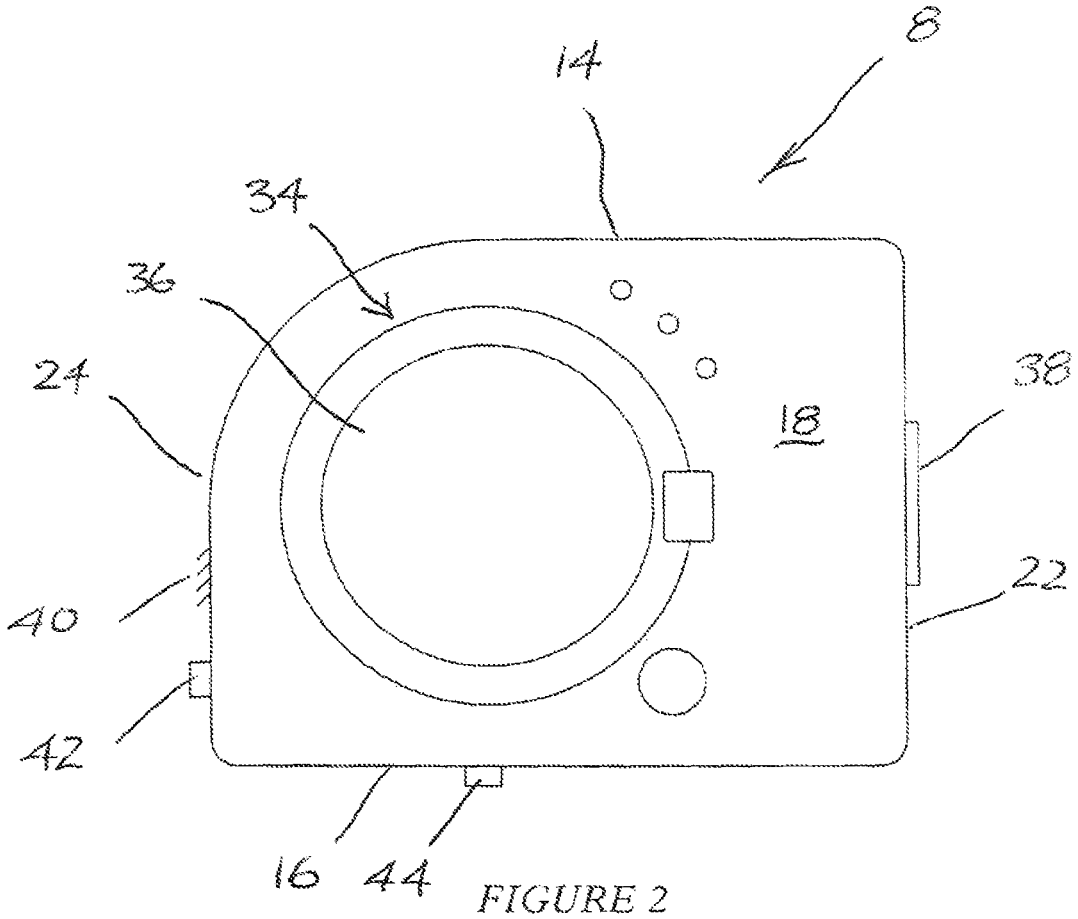
FIG. 2 is a front view of the cleaning apparatus of FIG. 1.

FIG. 1 shows a cleaning apparatus 8 to be used according to the invention which includes a body 10 which encloses a volume 12. The body includes a top 14, a base 16, a front panel 18, a rear panel 20 and two opposing side panels 22 and 24.

Figure 3:
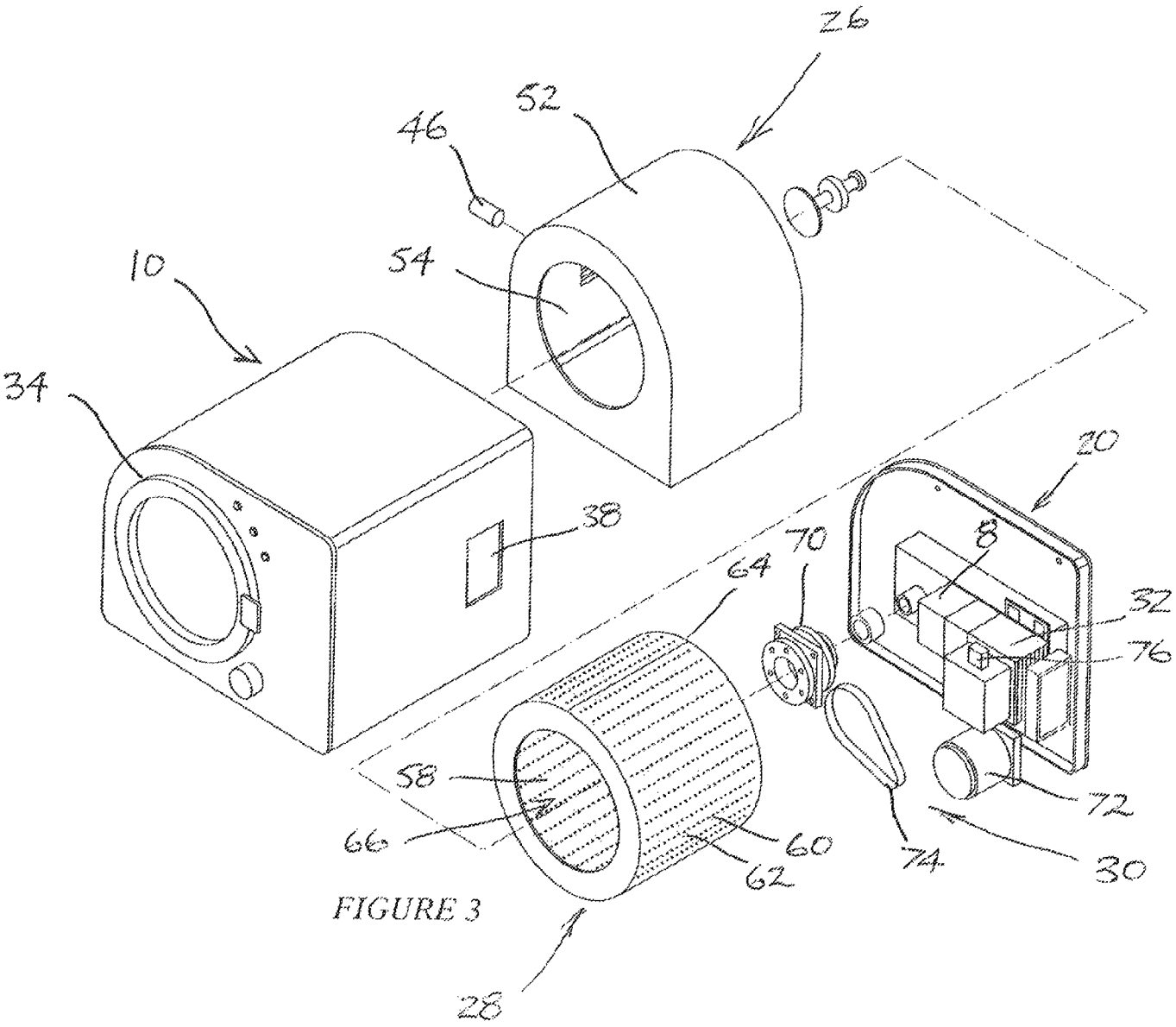
FIG. 3 is a perspective view of the cleaning apparatus of FIG. 1 in a disassembled form.

The apparatus further includes a tub 26, a drum 28, a drive means 30 and a generator 32 (see FIG. 3).

The front panel 18 has an aperture 34.

The aperture 34 is closed during operation of the cleaning apparatus by means of a closure 36, e.g. a door. The closure 36 is engaged with the body 10 by means of a hinge (not shown), but may also be removably engaged with the body 10.

The invention is not limited in this respect.

The body 10 includes a plurality of vents respectively 38 and 40, an inlet 42 and an outlet 44. The inlet 42 is in connection with a valve 46 e.g. a solenoid valve, which is engaged with the tub 26 and which regulates the passage of water into the tub 26. The outlet 44, which is also in connection with the tub 26, provides a passage for water out of the body 10. At least one of the plurality of vents is positioned on the side panel 22. A removable filter 50 covers the vent 38, which is on the side panel 22, and ensures that clean air is fed into the body 10.

The tub 26 is positioned inside the body 10 and includes an outer shell 52 and a cylindrical inner cavity 54. The openings of the cylindrical inner cavity 54 are in register with the aperture 34. The tub 26 is in connection with the inlet 42 and the outlet 44.

Figure 4:
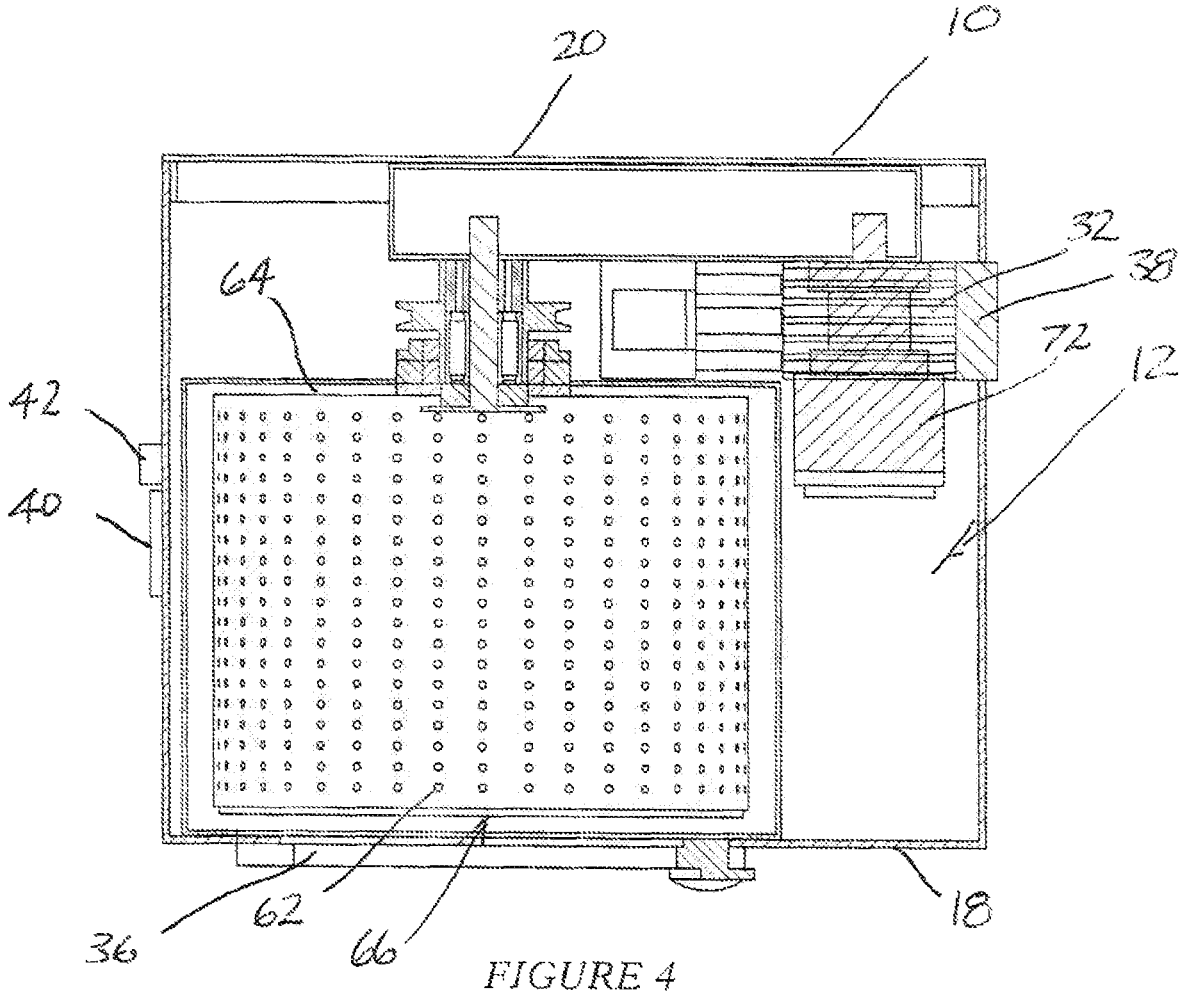
FIG. 4 is a plan view of the cleaning apparatus.

The drum 28 is located inside the tub 26 and includes an inner surface 58 and an outer surface 60, which closely lines the cylindrical inner cavity 54 of the tub 26, a base 64 and a mouth 66. The inner surface 58 and the outer surface 60 include a plurality of perforations 62 which allow water, which is in the tub during a wash cycle, to enter the drum 28. The base 64 is connected to the drive means 30 which allows for rotational movement of the drum about an axis during each wash cycle. The drive means 30 includes a pulley 70 which is linked to an electric motor 72 by means of a belt 74 e.g. a V-belt. The electric motor 72 is secured to the rear panel 20 of the body and causes the drum 28 to rotate for a predetermined duration and speed. This is best illustrated in FIG. 4.

The generator 32, which is located inside the body 10, includes a magnetron 76 which produces pulses of electromagnetic waves at a microwave frequency e.g. 2.45 GHz, which are directed into at least part of the drum 28.

Figure 5:
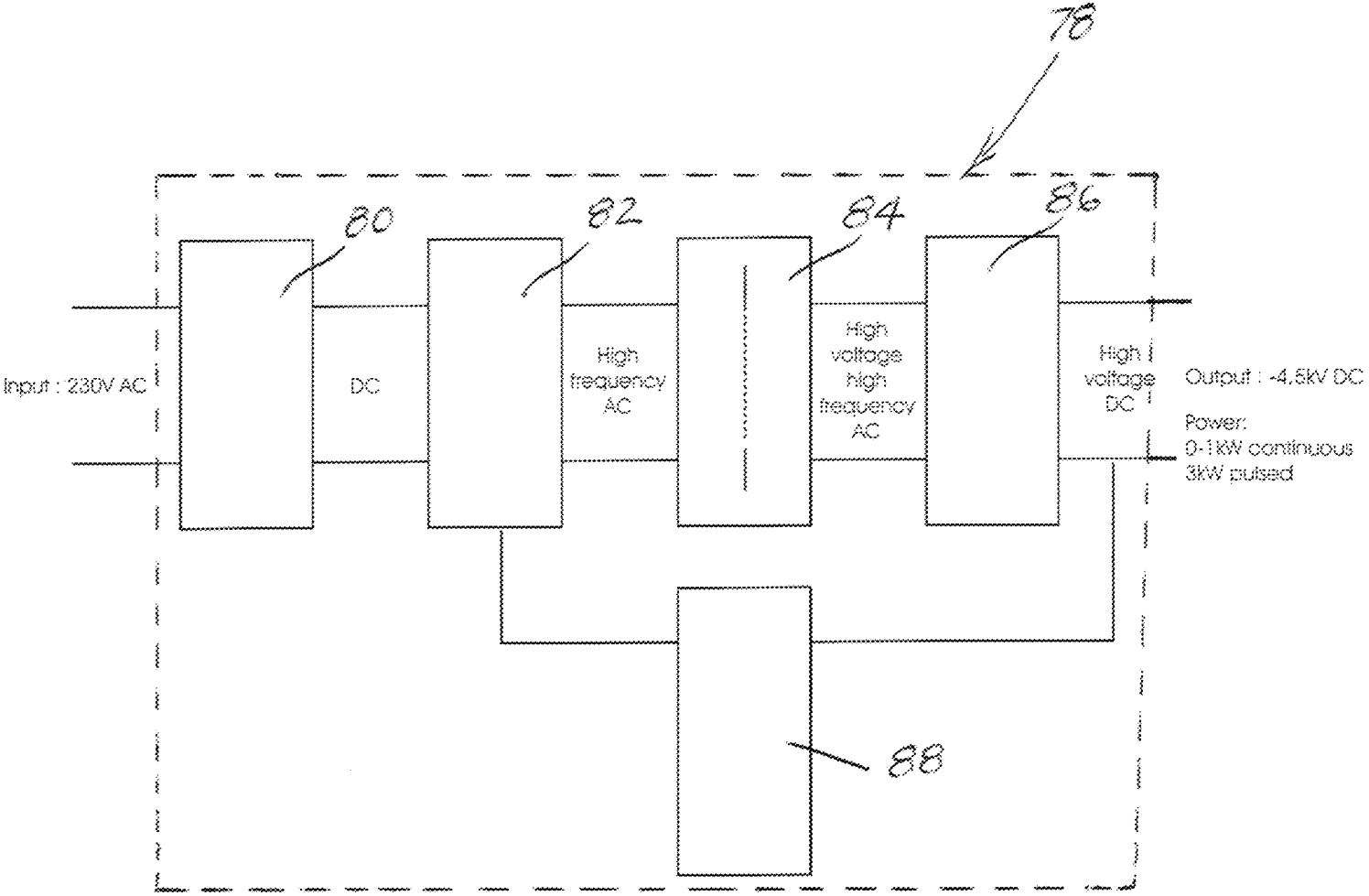
FIG. 5 is a typical power supply required to pulse a 1 kW magnetron.

FIG. 5 shows a block diagram of a typical switched-mode power supply 78 used to pulse the magnetron 76. The power supply 78 converts normal single-phase household mains electricity (230 Volts in South Africa) from alternating current (ac) form to direct current (dc) form, using a rectifier circuit 80. A switching circuit 82 then functions as an inverter which outputs high-frequency ac voltage. The frequency and duty cycle of this high-frequency ac voltage are controlled by a programmable microcontroller 88, which ultimately determines the output power of the power supply 78. The high-frequency ac voltage is ramped up using a step-up transformer 84, and then rectified by a second rectifier 86 to give an output dc voltage. This power supply 78 is used because of the following benefits: compact size; light weight due to exclusion of an iron transformer in its construction; variable output voltage and power due to existence of a programmable microcontroller 88 in its circuitry; and capabilities of supplying a pulsed output voltage.

The invention extends to a method that makes use of pulsed microwaves to clean cloth using the cleaning apparatus 8 described in detail above. Use of the apparatus 8 includes a wash cycle, during which microwave energy is used to clean cloth by removing stains, and drying cycles, during which microwave energy input is used to dry the cloth after a wash cycle.

The cloth to be washed is placed into the drum 28 as the wash load. During the wash cycle the microwave energy which is directed at high intensity into the drum 28 is thought to directly interact with a stain lodged in the cloth by causing it to heat up in preference to the surrounding cloth. Thus, the high intensity microwave energy allows the temperature of the stain to rise substantially above that of the surrounding textile within short intervals.

The microwave energy is applied in an intermittent (or pulsed) manner accelerating the cleaning process whilst keeping the cloth at a moderate temperature, thus preventing thermal damage to the cloth. The pulsed microwave energy is applied with sufficient power and in such a manner as to cause power densities ranging between 10 kW and 1000 kW per cubic meter of cavity volume within the drum. The microwave power density and duty cycle are selected to prevent eventual overheating of the wash load from the cumulative energy transfer.

The method of the invention results in a reduced quantity of detergent being required during a wash cycle. In some instances no detergent is required to wash articles.

Water is necessary to facilitate cleaning. However, the volume of the water in the drum 28 is minimised. This is because a large volume of water would absorb the microwave energy and reduce the differential heating effect. Large amounts of water may also cover the stain and attenuate the microwave field. Moistening of the cloth thereby occurs by continually spraying water via a water spray means 68 in the drum 28 (see FIG. 7) onto the wash load to carry off any grime released from the cloth and drain it from the drum 28 during the wash cycle. In this manner, the microwave energy available for application to the cloth is maximized.

The drum 28 has volume of between 10 to 100 litres. With the magnetron 76 having a power rating of 1 kW, the magnetron 76 can be pulsed at 3 kW for 33% of the time or at 5 kW for 20% of the time. The mentioned figures and volumes are not limiting in any way, and are merely exemplary, provided the use of the apparatus 8 results in the required power densities in the drum, i.e., between 10 kw and 1000 kW per cubic meter of cavity volume. This range is set by the need to limit the total energy input into the wash load, to prevent excessive temperatures.

At the end of a wash cycle the water, within the tub 26, is drained and leaves the body 10 through the outlet 44. Once the water is drained from the tub 26 the washed articles are dried by rotation of the drum 28 and by activation of the generator 32, usually at a reduced power output. The rotation of the drum 28 about an axis allows the energy which is created by the generator 32 to be distributed which ensures that all the cloth articles within the drum are evenly dried. In addition, air flow used to carry off the waste heat generated during operation by the microwave source can be heated further to a drying temperature of between 30° C. and 65° C. and vented through the cavity to effect the drying process.

The cycles are monitored and/or controlled via a process control system 89 according to one or more of the following process parameters: water quality (conductivity), flow and level; microwave power and duty cycle; gas/air velocity, humidity and temperature; drum rotation. The process control system include control elements, sensors and a programmable microcontroller 88, the latter which runs a generic control algorithm. The system 89 ensures optimal washing and drying performance of the apparatus 8 and also provides for monitoring of the quality of water to ensure that when saturation with dirt and grime is approached or reached, replacement of such water occurs.

Figure 7:
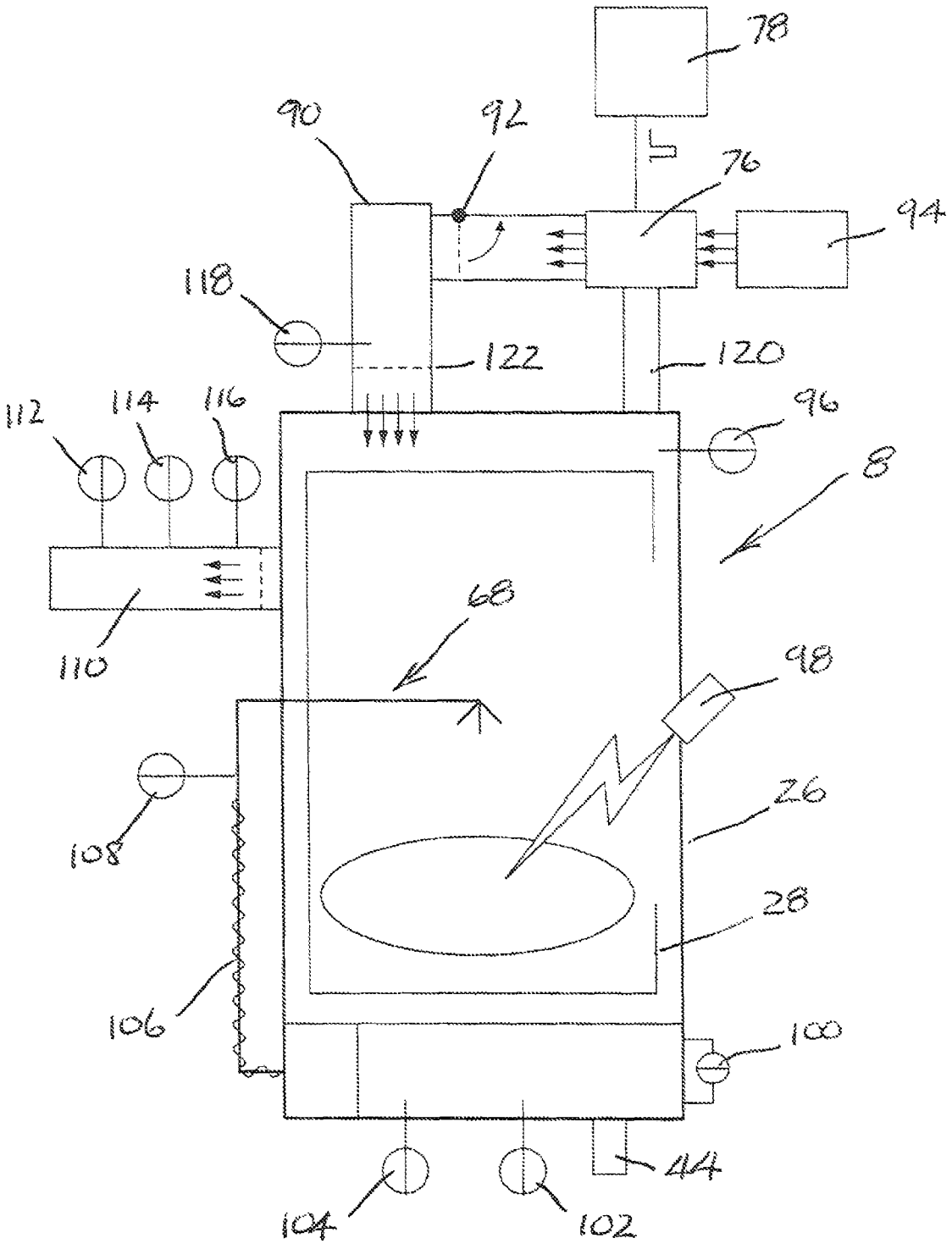
FIG. 7 is a schematic of a cleaning apparatus illustrating process control elements that are included.

A schematic layout of the apparatus 8, illustrating the components making up the process control system 89, is shown in FIG. 7. The system includes a plurality of sensors, including: a microwave field strength meter 96, a door-mounted infrared pyrometer 98, a sump water level sensor 100, a water conductivity sensor (conductivity meter) 102, a drain water level sensor (float switch) 104, a rinsing water temperature sensor (thermocouple) 108, an exhaust gas analyser 112, a humidity sensor (hygrometer) 114, an exhaust air temperature sensor (thermocouple) 116 and an inlet air temperature sensor (thermocouple) 118. The invention is not limited with respect to the type, number and location of the sensors within the apparatus 8.

A User Interface Panel 124 is present to provide a communications interface on which a user inputs washing load parameters of his choice, including size of the washing load, nature of the cloth to be washed (e.g. delicates) and scheduling of the wash.

Figure 6:
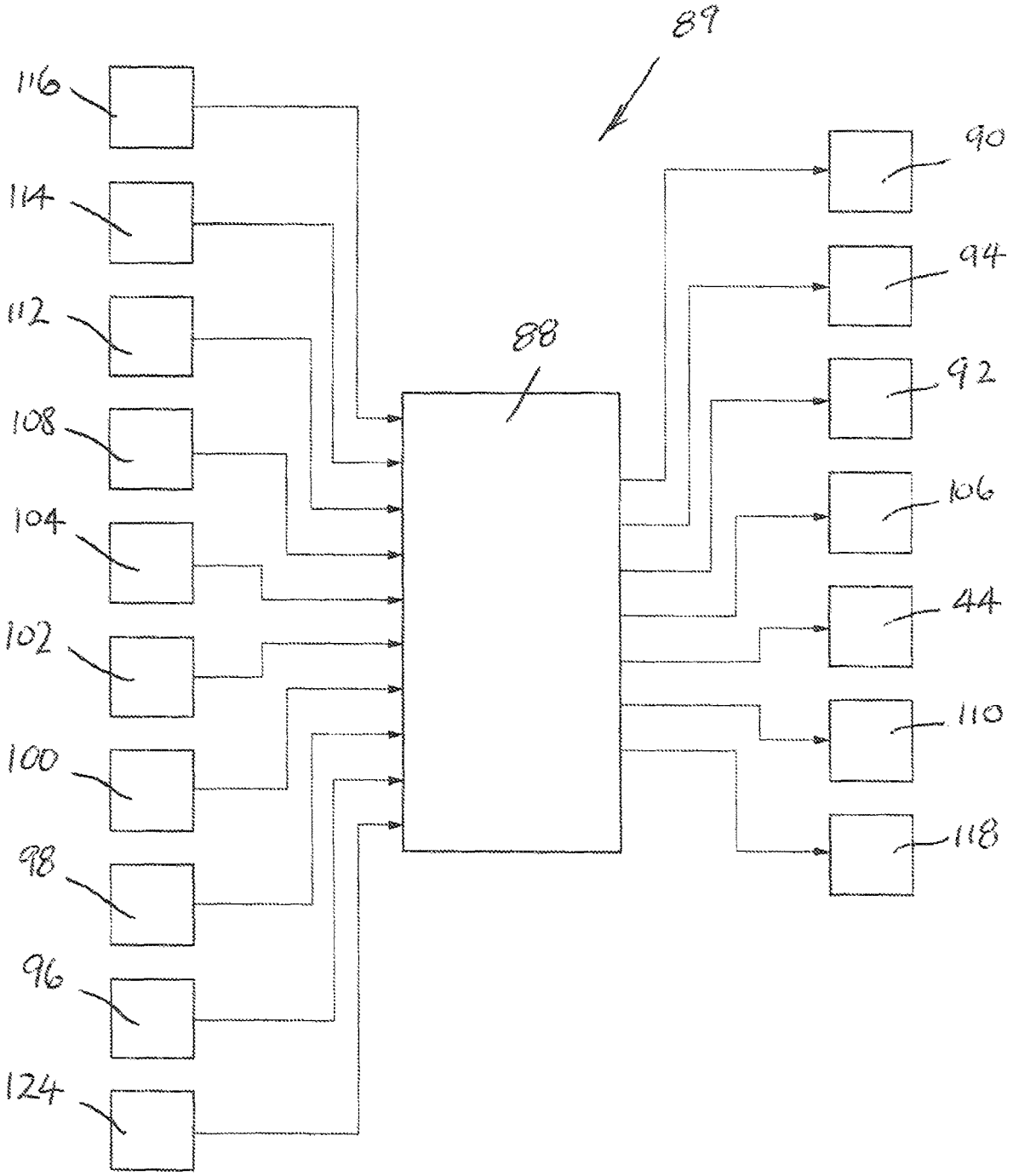
FIG. 6 shows the process control system. Inputs are on the left of the process controller and outputs are on the right.

The input washing load parameters, together with input feedback from the sensors, are communicated into the programmable microcontroller 88, which processes the input them according to the generic control algorithm. FIG. 6 is illustrative of this. Microcontroller 88 output then controls the functioning of the control elements of the apparatus 8, these elements include: an air heating element 90, an air blower 94 that blows air across the magnetron 76, an air bypass flap 92 that vents out air during the wash cycle, a microwave choke 120 that prevents microwave energy escaping from the tub 26, a microwave inlet 122, an optional water heater 106 for heating the rinsing water, and an exhaust air vent 110. Again, the invention is not limited to the type, number and location of the elements within the apparatus 8.

The magnetron 76 also forms part of the process control elements, as its output power can be controlled by the programmable microcontroller 88, thereby affecting the environmental conditions found within the apparatus 8.

The table below summarises the process parameters measured the element used and the functions of the element:

TABLE 1

| Parameter | Element used | Function |
|---|---|---|
| Inlet air temperature | Thermocouple | Used to monitor and regulate the temperature of air blown into the drum during drying |
| Exhaust air temperature | Thermocouple | Used to monitor the temperature of exhausted air during drying, to determine the humidity of the wash load |
| Drain water temperature | Thermocouple | Monitors temperature of water drained from the drum. Indicates the average temperature of the cloth |
| Rinse water temperature | Thermocouple | Monitors and controls the temperature of the heated water sprayed onto the wash load |
| Exhaust air humidity | Hygrometer | Monitors humidity of the wash load during drying |
| Gas presence | Gas analyser | Detects combustion products. Used as a safety device. Can also be used to detect volatile organic compounds, which indicate the type of stains present |

TABLE 1-continued

| Parameter | Element used | Function |
|---|---|---|
| Microwave field strength | Microwave field strength meter | Monitors microwave field strength. Can be used to derive wash load size and characteristics, to tailor the wash cycle. Also used as a protective device prevent arcing |
| Sump water level | Float switch | Detects water level to indicate start and end of cycles |
| Water conductivity | Conductivity meter | Measures dissolved products in water. Can be used to initiate an additional rinse cycle. Allows less water to be used per cycle |

The apparatus and method that has been described above provides an advanced or traditional washing machine concept of cleaning via mechanical agitation of cloth in detergent-bearing water. Combining the effectiveness of intermittent high-energy microwaves during the wash cycle, with microwave-assisted drying, allows an efficient small washer/dryer to be realised.

To illustrate the efficacy of the invention, experiments were undertaken comparing the cleaning performance of continuous-wave microwave power of the type disclosed in important piece of prior art US2002/0062667, with pulsed microwaves according to the present invention.

Figure 8:
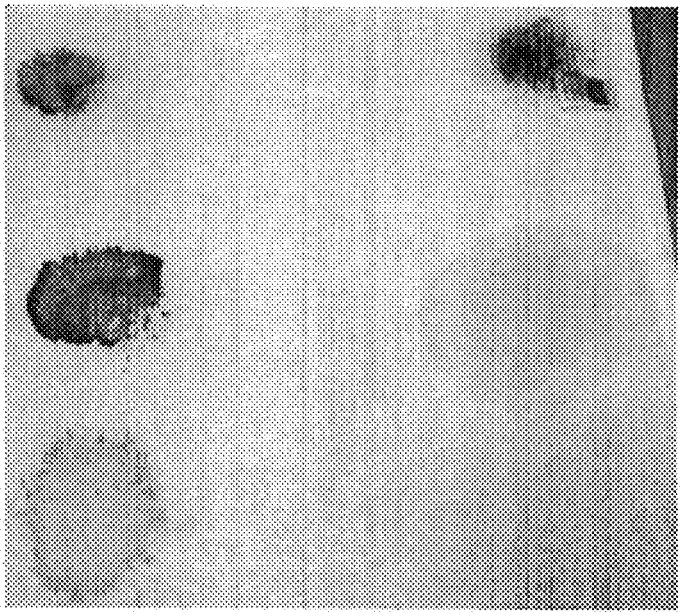
FIG. 8 is a prepared cloth to be cleaned experimentally using the invention, with various stains having been put on the cloth.
Figure 9:
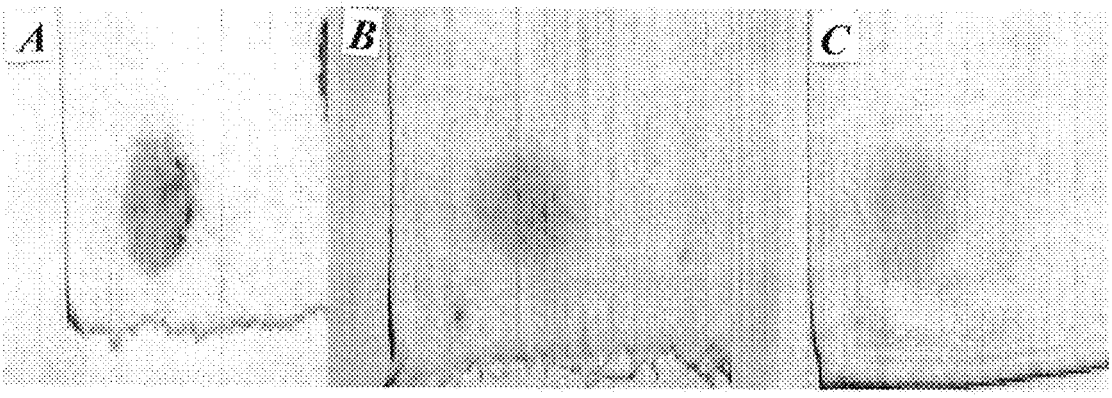
FIG. 9 compares a prepared grease stain with the cleaning results of continuous microwave energy and pulsing microwave energy after 10 minutes of cleaning using each method.
Figure 10:
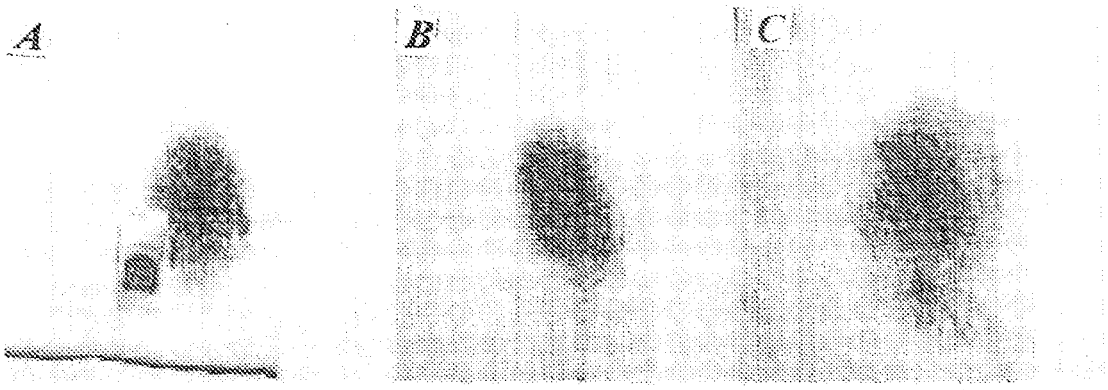
FIG. 10 compares a prepared Engine oil stain with the cleaning results of continuous microwave energy and pulsing microwave energy after 10 minutes of cleaning using each method.
Figure 11:
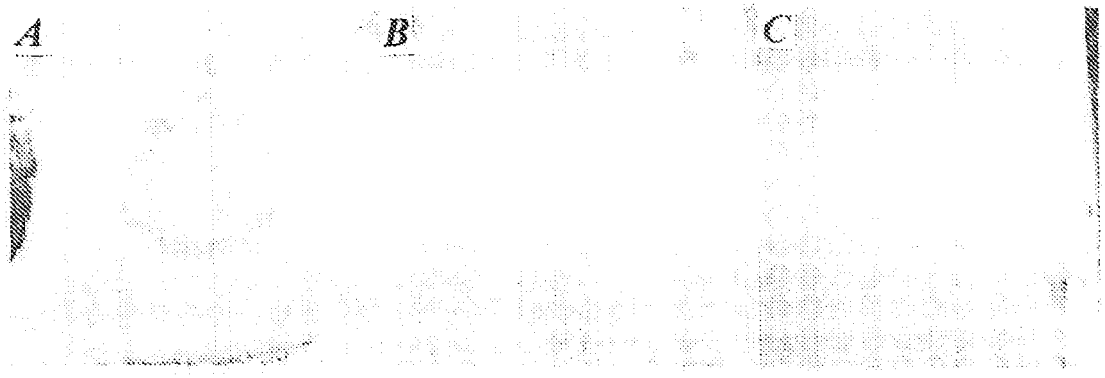
FIG. 11 compares a prepared Pepsi Cola stain with the cleaning results of continuous microwave energy and pulsing microwave energy after 10 minutes of cleaning using each method.
Figure 12:
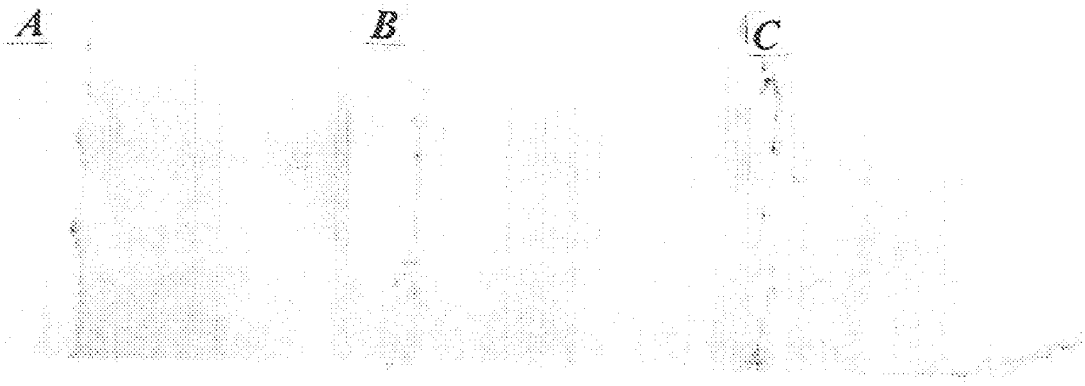
FIG. 12 compares a prepared Wood-oil stain with the cleaning results of continuous microwave energy and pulsing microwave energy after 10 minutes of cleaning using each method.
Figure 13:
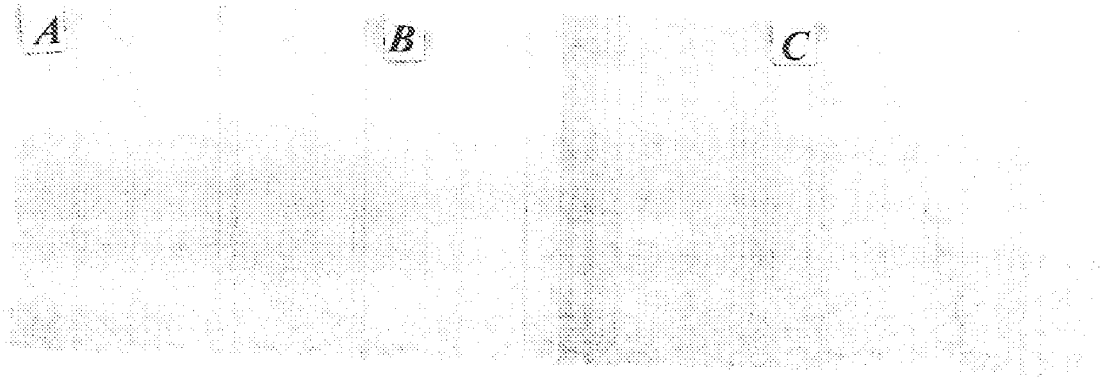
FIG. 13 compares the cleaning results of continuous microwave energy and pulsing microwave energy on a prepared Margarine stain after 10 minutes of cleaning using each method.
Figure 14:
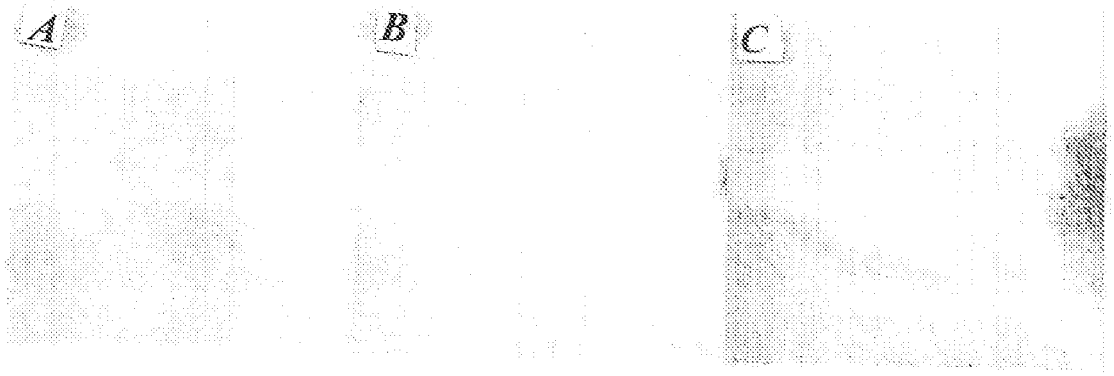
FIG. 14 compares a prepared Kool-aid stain with the cleaning results of continuous microwave energy and pulsing microwave energy after 10 minutes of cleaning using each method.
Figure 15:
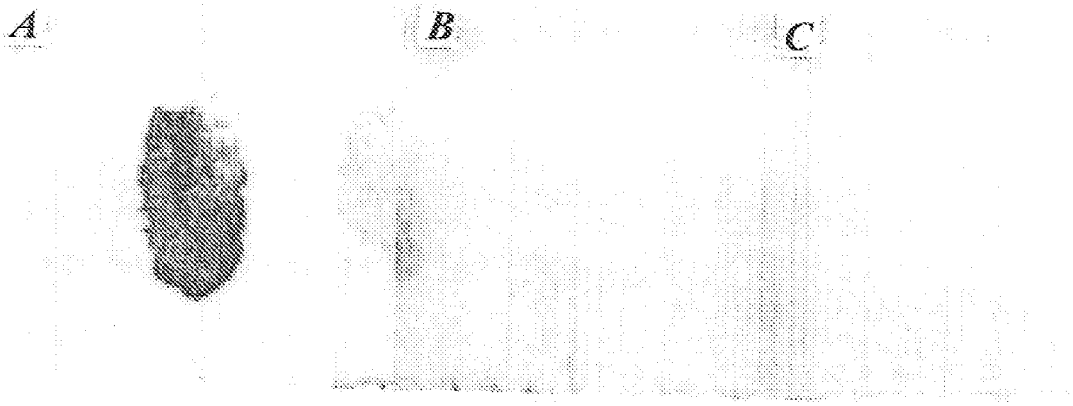
FIG. 15 compares a prepared Ketchup stain with the cleaning results of continuous microwave energy and pulsing microwave energy after 10 minutes of cleaning using each method.

Two identical cloths. Test-cloth 1 and Test-cloth 2, were prepared by staining them identically with clean grease, old engine oil, tomato ketchup, Kool-aid (crème soda flavour), Pepsi cola and wood stain (Teak oil), as illustrated in FIG. 8. Two microwave cleaning tests were done. Test-cloth 1 underwent a prior art test utilising a magnetron which generated continuous microwave energy to clean a prepared cloth. Test-cloth 2 underwent a pulsed microwave test utilising a magnetron which generated pulsed microwave energy to clean the other prepared cloth. The same type of apparatus as described in the preferred embodiment of this invention was used, the drum having a volume of 10 litres.

For the prior art test a constant microwave power of 20 kW per cubic meter of drum cavity volume (typical of a commercial magnetron attached to a domestic washing machine) was applied and the water temperature regulated at 40 degrees Celsius. For the pulsed microwave test a pulsed magnetron generating 80 kW per cubic meter of drum cavity volume was used, the pulse duty cycle being set to 25% in order to yield the same average power as the constant microwave power. Water temperature was also regulated at 40 degrees Celsius.

After 10 minutes of washing, the cloths were removed and the residual stains photographed.

FIG. 9 to 16 show analogies between the initial prepared stains (A) of FIG. 8, the cleaning results of the prior art test on Test-cloth 1 (B) for each stain, and the cleaning results of the pulsed microwave test on Test-cloth 2 (C) for each stain. The stains shown from FIGS. 9 to 15 are the following, respectively: Grease, Engine oil Pepsi, Wood oil, Margarine, Kool-aid and Ketchup.

Figure 16:
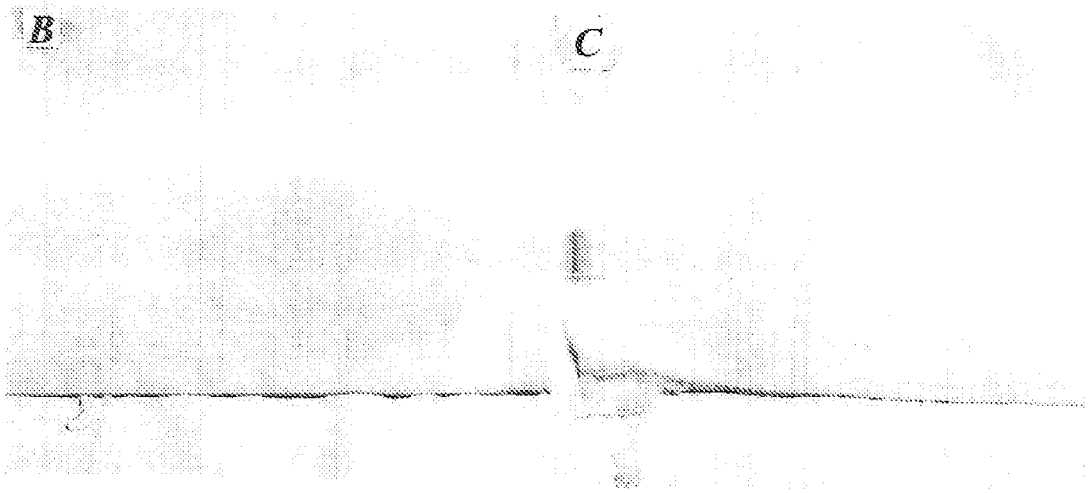
FIG. 16 compares the cleaning results of continuous microwave energy and pulsing microwave energy on a prepared Engine oil stain after 20 minutes of cleaning using each method.

The Engine oil stain was cleaned for a further 10-minute period FIG. 16 shows an analogy between Test-cloth 1 (B) and Test-cloth 2 (C) after this test.

The table below summarises the results:

TABLE 2

| Stain | Duration | continuous microwave energy | pulsed microwave energy |
|---|---|---|---|
| Grease | 10 minutes | less removed | more removed |
| Engine oil | 10 minutes | very little removed | noticeable removed |
| Pepsi | 10 minutes | 10% remained | completely removed |
| Wood oil | 10 minutes | partially removed | partially removed |
| Margarine | 10 minutes | partial removal | >90% removed |
| Koolaid | 10 minutes | removed | removed |
| Ketchup | 10 minutes | removed | removed |
| Engine on | 20 minutes | noticeable removal, similar to 10 minutes pulsed | Largely removed |

Longer wash cycles would have succeeded in removing more of the stains, but these test were sufficient to highlight the differences in the methods.

Use of pulsed microwaves yielded superior cleaning as compared to conventional microwave-assisted washing as described in the prior art.

The description of the preferred embodiments herein made is solely for the purposes of illustration. The invention is net limited solely by such description.

The invention claimed is:

1. A method of cleaning cloth with an apparatus which includes a body with an aperture; a closure, which is engageable with the aperture; a tub with an outer shell and a cylindrical inner cavity which corresponds with the aperture; a drum, which is positioned inside the cylindrical inner cavity and which includes a wall, with an inner surface, an outer surface and a plurality of perforations in the wall; a base and an opposing mouth which registers with the aperture; a drive means which is connected to or engaged with the drum and which allows rotational movement of the drum about an axis; a drive sensor to detect at least the temperature within the drum, a first control element and a programmable microcontroller or microprocessor circuit, electrically interposed between the drive sensor and the first control element, to receive input from the drive sensor and, in response, to control the operation of the first control element a generator and an electrical power supply, inside the body; wherein the power supply is adapted to provide pulsating electrical power to the generator and wherein the generator is actuable to produce pulses of microwave energy at least into part of the drum; the method including the steps of:

a) placing the cloth into the drum;

b) moistening the cloth in the drum with a liquid;

c) agitating the cloth in the drum by rotating the drum;

d) controlling the operation of the first control element to control the temperature in the drum; and e) irradiating the cloth in the drum with the pulses of microwave energy generated by the generator to provide a duty cycle between 5% and 33%, with each pulse generated in a range 1 kW to 30 kW, at a power density in the range of 23 kW to 100 kW per cubic meter.

2. The method according to claim 1 wherein the power of each pulse of microwave energy are regulated using the power supply to be in a range of 3 kW to 5 kW.

3. The method according to claim 1 wherein the cloth is moistened by spraying a stream of liquid into the drum.

4. The method according to claim 1 which includes an additional step of frequently or continuously draining the liquid out of the drum such that at least part of the cloth is not submerged during irradiation.

5. The method according to claim 1 which includes the additional step of introducing a hot air stream into the drum to dry the cloth.

6. The method according to claim 1 wherein the drum has a volume in the range of 10 to 100 liters.

7. The method according to claim 1 wherein the body includes a second sensor to detect at least one of the following: microwave field strength, sump water level, water conductivity, drain water level, rinsing water temperature, exhaust gas humidity, exhaust air temperature and inlet air temperature.

8. The method according to claim 7, wherein the apparatus includes a second control element and by control of the operation of the control element, the programmable microcontroller or microprocessor is capable of controlling any one or more of the following: water flow, water quality, water level, microwave power, duty cycle, air velocity and drum rotation.

* * * * *